US010832864B2

(12) United States Patent
Kuribayashi et al.

(10) Patent No.: US 10,832,864 B2
(45) Date of Patent: Nov. 10, 2020

(54) METHOD FOR PRODUCING RARE-EARTH MAGNETS, AND RARE-EARTH-COMPOUND APPLICATION DEVICE

(71) Applicant: SHIN-ETSU CHEMICAL CO., LTD., Tokyo (JP)

(72) Inventors: Yukihiro Kuribayashi, Echizen (JP); Shogo Kamiya, Echizen (JP); Harukazu Maegawa, Echizen (JP); Shintaro Tanaka, Echizen (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 0 days.

(21) Appl. No.: 15/570,202

(22) PCT Filed: Apr. 18, 2016

(86) PCT No.: PCT/JP2016/062190
§ 371 (c)(1),
(2) Date: Oct. 27, 2017

(87) PCT Pub. No.: WO2016/175059
PCT Pub. Date: Nov. 3, 2016

(65) Prior Publication Data

US 2018/0137974 A1 May 17, 2018

(30) Foreign Application Priority Data

Apr. 28, 2015 (JP) ..... 2015-091965

(51) Int. Cl.
*H01F 41/02* (2006.01)
*B05C 3/10* (2006.01)
(Continued)

(52) U.S. Cl.
CPC ..... *H01F 41/0293* (2013.01); *B05C 3/10* (2013.01); *B05C 13/02* (2013.01); *B05D 3/0413* (2013.01);
(Continued)

(58) Field of Classification Search
CPC ..... H01F 7/02; H01F 1/053; H01F 1/0536; B05C 3/10; B05C 3/02; B05D 1/10; B05D 1/02
(Continued)

(56) References Cited

U.S. PATENT DOCUMENTS 7,559,996 B2 7/2009 Miyata et al.
8,377,233 B2 2/2013 Nakamura et al.
(Continued)

FOREIGN PATENT DOCUMENTS

CN 102483980 A 5/2012
JP 52-130019 * 10/1976
(Continued)

OTHER PUBLICATIONS

International Search Report for PCT/JP2016/062190 dated Jul. 19, 2016.
(Continued)

*Primary Examiner* — Tabassom Tadayyon Eslami
(74) *Attorney, Agent, or Firm* — Birch, Stewart, Kolasch & Birch, LLP

(57) ABSTRACT

A coating tank 1 provided with a net belt passage opening is prepared, a slurry obtained by dispersing a rare-earth-compound powder in a solvent is continuously supplied to the coating tank 1 to cause the coating tank 1 to overflow, and a plurality of sintered magnet bodies 10 are arranged on a net belt conveyor 5, continuously conveyed horizontally thereon, and passed through the slurry in the coating tank 1 via the net belt passage opening, to apply the slurry to the
(Continued)

sintered magnet bodies. The slurry is subsequently dried to continuously apply the powder to the plurality of sintered magnet bodies. As a result, the rare-earth-compound powder can be uniformly applied to the surfaces of the sintered magnet bodies, and the application operation can be performed extremely efficiently.

10 Claims, 2 Drawing Sheets

(51) Int. Cl.

| | |
|---|---|
| ***B05C 13/02*** | (2006.01) |
| ***B22F 3/24*** | (2006.01) |
| ***C22C 38/00*** | (2006.01) |
| ***B22F 3/00*** | (2006.01) |
| ***B05D 3/04*** | (2006.01) |
| ***B05D 7/24*** | (2006.01) |
| ***C22C 38/02*** | (2006.01) |
| ***C22C 38/06*** | (2006.01) |
| ***C22C 38/16*** | (2006.01) |
| ***H01F 1/057*** | (2006.01) |
| *B05D 1/18* | (2006.01) |
| *B22F 9/02* | (2006.01) |
| *B22F 9/04* | (2006.01) |

(52) U.S. Cl.
CPC ..... *B05D 7/24* (2013.01); *B22F 3/00* (2013.01); *B22F 3/24* (2013.01); *C22C 38/00* (2013.01); *C22C 38/002* (2013.01); *C22C 38/005* (2013.01); *C22C 38/02* (2013.01); *C22C 38/06* (2013.01); *C22C 38/16* (2013.01); *H01F 1/0577* (2013.01); *B05D 1/18* (2013.01); *B05D 3/042* (2013.01); *B05D 2401/10* (2013.01); *B05D 2401/32* (2013.01); *B22F 9/023* (2013.01); *B22F 9/04* (2013.01); *B22F 2009/044* (2013.01)

(58) Field of Classification Search
USPC ..... 438/61, 907; 437/926; 118/26, 400, 118/429; 427/471, 498, 512, 594, 601, 427/96.9
See application file for complete search history.

(56) References Cited

U.S. PATENT DOCUMENTS

| | | | | |
|---|---|---|---|---|
| 2008/0245442 | A1* | 10/2008 | Nakamura | B22F 9/023 148/101 |
| 2008/0247898 | A1 | 10/2008 | Nakamura et al. | |
| 2012/0139388 | A1* | 6/2012 | Iwasaki | B22F 3/24 310/254.1 |
| 2013/0271248 | A1 | 10/2013 | Nagata et al. | |
| 2015/0233007 | A1* | 8/2015 | Kuribayashi | H01F 41/0293 205/122 |

FOREIGN PATENT DOCUMENTS

| | | | |
|---|---|---|---|
| JP | 52-130019 | A | 11/1977 |
| JP | 56-7655 | A | 1/1981 |
| JP | 4-108580 | A | 4/1992 |
| JP | 2002-2226998 | * | 8/2002 |
| JP | 2003-332162 | * | 11/2003 |
| JP | 2003-332162 | A | 11/2003 |
| JP | 2003-3332162 | * | 11/2003 |
| JP | 2007-53351 | A | 3/2007 |
| JP | 2007-297687 | A | 11/2007 |
| JP | 2002-220675 | * | 8/2012 |
| JP | 2013-236071 | A | 11/2013 |
| WO | WO 2006/043348 | A1 | 4/2006 |
| WO | WO 2011/108704 | A1 | 9/2011 |

OTHER PUBLICATIONS

Extended European Search Report dated Oct. 26, 2018, for corresponding European Patent Application No. 16786336.4.
Chinese Office Action and Search Report dated May 8, 2019, for corresponding Chinese Application No. 201680024631.4.

* cited by examiner

METHOD FOR PRODUCING RARE-EARTH MAGNETS, AND RARE-EARTH-COMPOUND APPLICATION DEVICE

TECHNICAL FIELD

The present invention relates to a method for producing rare-earth magnets in which when a rare-earth permanent magnet is produced by applying and heat treating a powder containing a rare-earth compound onto sintered magnet bodies to permit a rare-earth element to be absorbed in the sintered magnet bodies, the powder of the rare-earth compound is uniformly and efficiently applied to efficiently obtain rare-earth magnets having excellent magnetic properties, and also to an application device of a rare-earth compound preferably used for the method for producing the rare-earth magnets.

BACKGROUND ART

Rare-earth permanent magnets based on Nd—Fe—B have been increasingly in use because of their excellent magnetic properties. Hitherto, as a method of further improving coercivity of the rare-earth magnet, there is known a method in which a powder of a rare-earth compound is applied onto the surface of sintered magnet bodies and heat treated to permit the rare-earth element to be absorbed and diffused in the sintered magnet bodies to obtain rare-earth permanent magnets (Patent Document 1: JP-A 2007-53351 and Patent Document 2: WO 2006/043348). According to this method, it is possible to increase coercivity while suppressing the reduction of a remanence.

However, there is still a room of further improvement in this method. More particularly, for the application of the rare-earth compound, an usual method is such that sintered magnet bodies are immersed in a slurry of a powder containing the rare-earth compound dispersed in water or an organic solvent, or the slurry is applied to by spraying over the sintered magnet bodies, and dried in both cases. The immersion method and the spraying method have difficulty in controlling a coating amount of the powder, with the possibility that a rare-earth element may not be fully absorbed, or, in contrast, an excessive powder may be applied thereby leading to the unnecessary consumption of the precious rare-earth element. Additionally, variation in coating film thickness is likely to occur and the denseness of the film is not high, so that an excessive coating amount is necessary for allowing for an increase in coercivity to saturation. Moreover, the adhesion force of the coating film made of powder is so low that a workability ranging from a coating step to completion of a heat treatment step is not always good.

Accordingly, there has been demanded the development of a coating method that is able to coat a powder of a rare-earth compound uniformly and efficiently and can form a dense powder coating film with good adhesion under control of a coating amount.

PRIOR ART DOCUMENTS

Patent Documents

Patent Document 1: JP-A 2007-53351

Patent Document 2: WO 2006/043348

SUMMARY OF THE INVENTION

Problems to be Solved by the Invention

The present invention has been made under such circumstances as described above and has for its object the provision of a method for producing rare-earth magnets in which when a powder containing one or at least two selected from an oxide, a fluoride, an oxyfluoride, a hydroxide, or a hydride of $R^2$ (wherein $R^2$ represents one or at least two selected from rare-earth elements including Y and Sc) is applied onto a surface of sintered magnet bodies made of an $R^1$—Fe—B-based composition (wherein $R^1$ is one or at least two selected from rare-earth elements including Y and Sc) and heat treated to produce rare-earth permanent magnets, the powder can be coated uniformly and efficiently, a dense powder coating film can be formed with good adhesion under control of a coating amount, and the rare-earth magnets having more excellent magnetic properties can be efficiently obtained, and also a coating device of a rare-earth compound that is conveniently used for the method of producing rare-earth magnets.

Means for Solving the Problems

In order to achieve the above object, the present invention provides a method for producing rare-earth magnets of the following [1] to [5].

[1] A method for producing rare-earth magnets by applying a powder containing one or at least two selected from an oxide, a fluoride, an oxyfluoride, a hydroxide, or a hydride of $R^2$ (wherein $R^2$ represents one or at least two selected from rare-earth elements including Y and Sc) onto sintered magnet bodies made of an $R^1$—Fe—B-based composition (wherein $R^1$ is one or at least two selected from rare-earth elements including Y and Sc) and heat treated to permit $R^2$ to be absorbed in the sintered magnet bodies. The method for producing rare-earth permanent magnets is characterized by providing a coating tank having a net belt passage opening at two mutually facing side walls individually, continuously feeding a slurry dispersing the powder in a solvent until overflowed, arranging a plurality of the sintered magnet bodies on a net belt conveyor and continuously conveying the sintered magnet bodies horizontally, applying the slurry onto the sintered magnet bodies that are passed into the slurry in the coating tank through the net belt passage openings, and drying the sintered magnet bodies to remove the solvent of the slurry thereby continuously applying the powder onto the plurality of sintered magnet bodies.

[2] The method for producing rare-earth magnets of [1], in which the sintered magnet bodies are subjected to plural times of a coating process in which the sintered magnet bodies are passed into the slurry in the coating tank and dried.

[3] The method for producing rare-earth magnets of [1] or [2], in which the sintered magnet bodies are discharged from the coating tank and air is injected against the conveyed sintered magnet bodies to remove drippings therefrom, followed by drying treatment.

[4] The method for producing rare-earth magnets of any of [1] to [3], in which the drying treatment is carried out by injecting air at a temperature within ±50° C. of a boiling point ($T_B$) of the solvent for the slurry against the rare-earth magnets.

[5] The method for producing rare-earth magnets of any of [1] to [4], in which a net belt of the net belt conveyor is covered with a pressing net belt and the sintered magnet bodies are conveyed while being held between these net belts.

In order to achieve the above object, the present invention provides an application device of a rare-earth compound of the following [6] to [13].

[6] An application device of a rare-earth compound of a type in which when a powder containing one or at least two selected from an oxide, a fluoride, an oxyfluoride, a hydroxide, or a hydride of $R^2$ (wherein $R^2$ represents one or at least two selected from rare-earth elements including Y and Sc) is applied onto sintered magnet bodies made of an $R^1$—Fe—B-based composition (wherein $R^1$ is one or at least two selected from rare-earth elements including Y and Sc) and heat treated to permit $R^2$ to be absorbed in the sintered magnet bodies to produce rare-earth permanent magnets, the application device is applied the powder onto the sintered magnet bodies. The application device includes a net belt conveyor linearly conveying the sintered magnet bodies along a horizontal direction, a box-shaped inner tank having a net belt passage opening at two mutually facing side walls individually and accommodating a slurry dispersing the powder in a solvent for applying the slurry onto the sintered magnet bodies by immersion in the slurry, an outer tank receiving the slurry overflowed from the inner tank, slurry return means for returning the slurry in the outer tank to the inner tank, and drying means for drying a surface of the sintered magnet bodies discharged from the inner tank to remove the solvent of the slurry so that the powder is fixedly deposited on the surface of the sintered magnet bodies. The powder is fixedly deposited on the surface of the sintered magnet bodies by continuously feeding the slurry to the inner tank, overflowing the slurry so as to allow the slurry to be accommodated in the outer tank and circulating the slurry by returning from the outer tank to the inner tank by the slurry return means, horizontally conveying the sintered magnet bodies by means of the net belt conveyor, immersing the sintered magnet bodies into the slurry by introduction from one of the net belt passage openings of the inner tank into the inner tank and discharging from the other net belt passage opening thereby applying the slurry onto the sintered magnet bodies, and drying with the drying means to remove the solvent of the slurry thereby fixedly depositing the powder on the surface of sintered magnet bodies.

[7] The application device of a rare-earth compound of [6], further includes dripping removal means provided between the inner tank and the drying means and capable of injecting air against the sintered magnet bodies being horizontally conveyed with the net belt conveyor to remove drippings of the slurry on the surface of the sintered magnet bodies.

[8] The application device of a rare-earth compound of [6] or [7], further includes a pressing net belt covering over the net belt of the net belt conveyor and moving in synchronism with the net belt conveyor, the sintered magnet bodies being held between the net belts and conveyed.

[9] The application device of a rare-earth compound of any of [6] to [8], in which a drying zone provided with the drying means, or both the drying zone and a dripping removal zone in which the dripping removal means is provided are covered with a chamber, and dust collecting means is further provided for dust collection by suctioning air in the chamber to collect the powder of the rare-earth compound removed from the surface of the sintered magnet bodies.

[10] The application device of a rare-earth compound of any of [6] to [9], further includes a slurry storage tank for once storing the slurry discharged from the outer tank for slurry control when the slurry is returned from the outer tank to the inner tank by the slurry return means.

[11] The application device of a rare-earth compound of any of [6] to [10], in which the application device is configured such that a plurality of modules each including the inner tank, the outer tank, the slurry return means, and the drying means are arranged in series, and the sintered magnet bodies on the net belt conveyor are passed through the plurality of the modules to repeat a powder applied process including from the slurry application to the drying plural times.

[12] The application device of a rare-earth compound of any of [6] to [11], in which the application device is configured such that the net belt of the net belt conveyor has a multitude of protrusions arranged uniformly on an upper surface of the net belt and the sintered magnet bodies are disposed on the multitude of protrusions.

[13] The application device of a rare-earth compound of any of [6] to [12], in which the net belt of the net belt conveyor is a net-shaped weave of a metal wire and has a multitude of protrusions, on an upper surface of the net belt, projected by folding part of the metal wire in a form of a triangle.

That is, the production method and the application device of the present invention are ones in which the slurry dispersing a powder of a rare-earth compound in a solvent is continuously fed to the coating tank (inner tank) until overflowed, a plurality of sintered magnet bodies horizontally conveyed with the net belt conveyor are continuously passed into the slurry in the coating tank (inner tank) for immersion application of the slurry, and the sintered magnet bodies continuously discharged from the coating tank (inner tank) are dried by the drying means to remove the solvent of the slurry thereby continuously applying the powder of the rare-earth compound onto a plurality of sintered magnet bodies.

Advantageous Effects of the Invention

According to the present invention, since the slurry is subjected to immersion application to the sintered magnet bodies in the state where the slurry is continuously fed to the coating tank (inner tank) and overflowed by use of the slurry return means, the immersion application can be performed while invariably keeping the slurry in a constant state. The drying is carried after application of the slurry while conveying with the net belt conveyor, so that the application treatment of the powder of the rare-earth compound can be continuously performed against the plurality of sintered magnet bodies. Moreover, the sintered magnet bodies can be applied with the slurry while being horizontally conveyed with the net belt conveyor and can be dried as they are, so that when a multitude of sintered magnet bodies are arranged at small intervals and conveyed, adjacent sintered magnet bodies do not mutually contact with each other thereby enabling very efficient continuous treatment and allowing automated operations in an easy way. In view of the foregoing, the coating amount of the powder of the rare-earth compound can be made uniform and can be correctly controlled, thus leading to the efficient formation of an even, uniform coating film of the powder of the rare-earth compound.

According to the production method and application device of the present invention, since the powder of a rare-earth compound can be uniformly applied onto the surface of sintered magnet bodies as set out above and the application operations can be very efficiently performed, there can be efficiently produced rare-earth magnets which are excellent in magnetic properties including well increased coercivity.

BRIEF DESCRIPTION OF THE DIAGRAMS

EMBODIMENT FOR CARRYING OUT THE INVENTION

Figure 1:
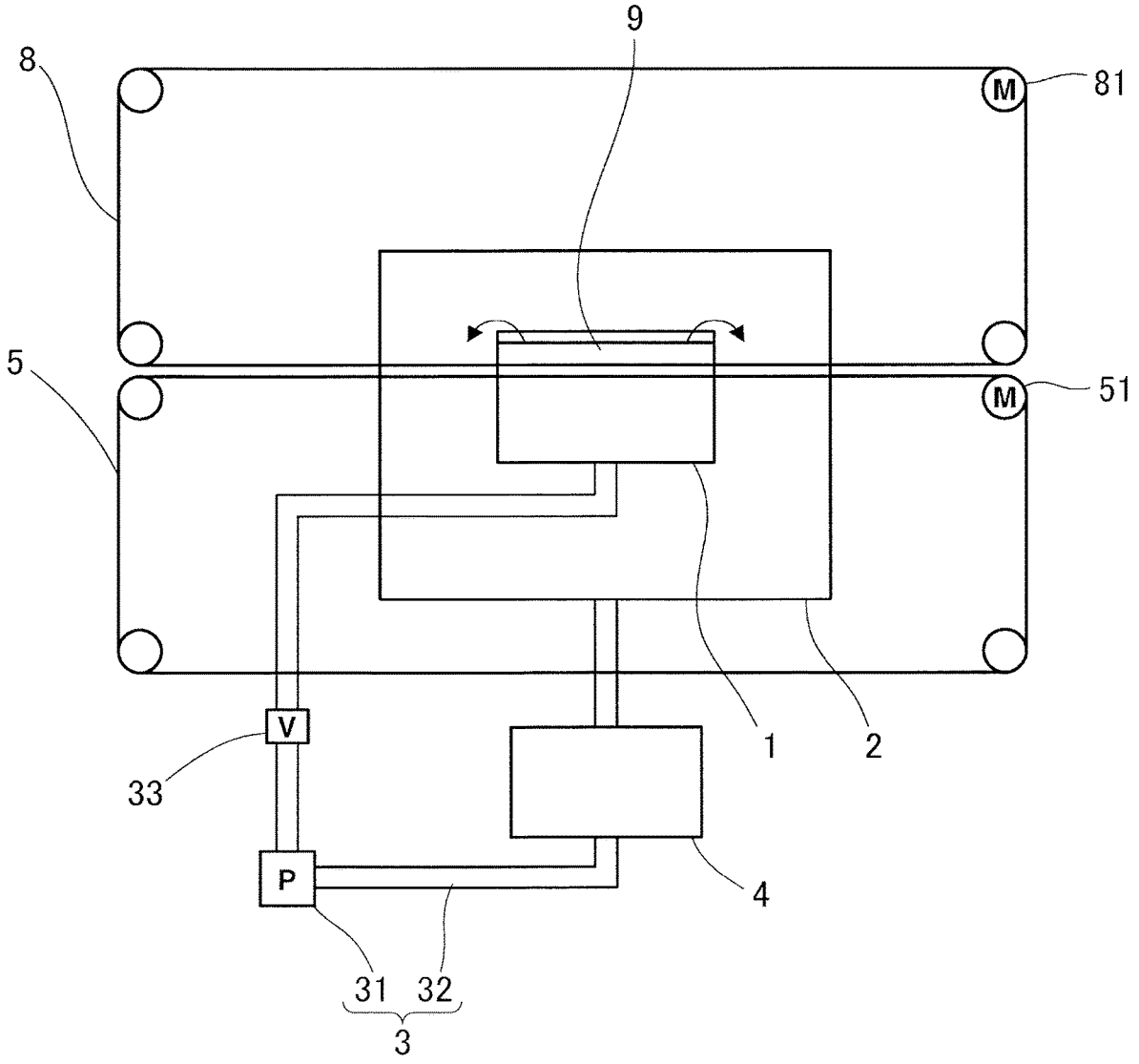
FIG. 1 is a schematic view depicting an application device related to one example of the present invention.

The method for producing rare-earth magnets of the present invention is one in which as stated above, a powder containing an oxide, a fluoride, an oxyfluoride, a hydroxide, or a hydride of $R^2$ (wherein $R^2$ is one or at least two selected from rare-earth elements including Y and Sc) is applied onto sintered magnet bodies made of an $R^1$—Fe—B-based composition (wherein $R^1$ is one or at least two selected from rare-earth elements including Y and Sc) and heat treated to permit $R^2$ to be absorbed in the sintered magnet bodies thereby producing rare-earth magnets.

The $R^1$—Fe—B-based sintered magnet bodies may be ones obtained by known methods and can be obtained, for example, according to an ordinary method in which a mother alloy containing R', Fe, and B is coarsely milled, finely pulverized, formed, and sintered. It is noted that $R^1$ is one or at least two selected from rare-earth elements including Y and Sc as defined above, and particular mention is made of Y, Sc, La, Ce, Pr, Nd, Sm, Eu, Gd, Tb, Dy, Ho, Er, Yb, and Lu.

In the present invention, the $R^1$—Fe—B-based sintered magnet bodies are shaped into a given form such as by grinding, if necessary, and are applied onto the surface thereof with a powder containing one or at least two of an oxide, a fluoride, an oxyfluoride, a hydroxide, and a hydride of $R^2$ and heat treated for absorption and diffusion (grain boundary diffusion) in the sintered magnet bodies to obtain rare-earth magnets.

As defined above, $R^2$ is one or at least two selected from rare-earth elements including Y and Sc, for which mention is made of Y, Sc, La, Ce, Pr, Nd, Sm, Eu, Gd, Tb, Dy, Ho, Er, Yb, and Lu like $R^1$. In this case, although not specifically limited, it is preferred that Dy or Tb is contained in total in $R^2$, taken singly or plurally, at least 10 at %, more preferably at least 20 at %, and much more preferably at least 40 at %. In view of the purpose of the present invention, it is more preferred that the Dy and/or Tb is contained in $R^2$ at least 10 at % and a total concentration of Nd and Pr in $R^2$ is lower than a total concentration of Nd and Pr in $R^1$.

In the present invention, the application of the powder is carried out by preparing a slurry by dispersing the powder in a solvent, and applying and drying the slurry onto the surface of sintered magnet bodies. In this case, the particle size of the powder is not specifically limited, and an ordinary size for absorption and diffusion (grain boundary diffusion) of a powder of a rare-earth compound can be used. More particularly, the average particle size is preferably up to 100 μm and more preferably up to 10 μm. Although not particularly limited, the lower limit is preferably at least 1 nm. This average particle size can be obtained, for example, as an average value by weight $D_{50}$ (i.e. a particle size or a median size at a cumulative weight of 50%) determined by use of a particle size distribution measuring device using the like such as the laser diffractometry. It is noted that the solvent for dispersion of the powder may be either water or an organic solvent. The organic solvent is not specifically limited and includes, for example, ethanol, acetone, methanol, isopropyl alcohol or the like. Of these, ethanol is preferably used.

Although the amount of the powder dispersed in the slurry is not specifically limited, it is preferred in the present invention that in order to apply the powder in a good and efficient manner, the dispersion amount is such that the slurry has a mass fraction of at least 1%, more preferably at least 10%, and much more preferably at least 20%. It is noted that if the dispersion amount is too large, a disadvantage is caused in that a uniform dispersion cannot be obtained, so that the upper limit is such that the mass fraction is preferably up to 70%, more preferably up to 60%, and much more preferably up to 50%.

In the present invention, as a method of applying the powder onto the surface of sintered magnet bodies by applying the slurry onto sintered magnet bodies and drying, there can be adopted a method in which the slurry is continuously supplied to a coating tank until overflowed, arranging a plurality of the sintered magnet bodies on the net belt conveyor and continuously conveying them horizontally for passage into the slurry in the coating tank thereby applying the slurry onto the sintered magnet bodies, and drying the sintered magnet bodies. More particularly, the application operations of the powder can be performed using an application device depicted in FIG. 1.

That is, FIG. 1 is a schematic view depicting an application device of a rare-earth compound related to one example of the present invention. This application device is one in which the sintered magnet bodies is horizontally conveyed by a net belt conveyor 5 for passage into the slurry accommodated in an inner tank (coating tank) 1 to apply the slurry, drippings of the slurry are removed in a dripping removal zone, not depicted, followed by drying in a drying zone, not depicted, to remove the solvent of the slurry, thereby applying the powder of the rare-earth compound onto the sintered magnet bodies.

The inner tank 1 is a coating tank in which the slurry is accommodated and the sintered magnet bodies are immersed in the slurry 9 for applying the slurry 9 onto the surface of the sintered magnet bodies. The inner tank 1 is set in a larger-size outer tank 2 and is in a state accommodated in the outer tank 2. The inner tank 1 and the outer tank 2 are connected with slurry return means 3 having a pump 31 and a pipe arrangement 32. The slurry return means 3 acts to continuously feed the slurry 9 to a lower portion of the inner tank 1 so that the slurry 9 is overflowed from an upper portion of the inner tank 1, and the slurry 9 overflowed from the inner tank 1 is received in the outer tank 2, followed by re-feeding the slurry to the inner tank 1 by the slurry return means. In other words, a given amount of the slurry 9 is circulated in the order of the inner tank 1, the outer tank 2, the slurry return means 3, and the inner tank 1.

In the device of FIG. 1, a liquid storage tank 4 is provided in the middle of the pipe arrangement 32 of the slurry return means 3. The slurry 9 discharged from the outer tank 2 is once stored in the liquid storage tank 4, followed by re-feeding the slurry to the inner tank 1. In the liquid storage tank 4, the amount and temperature of the slurry 9 are controlled. The slurry return means 3 is provided with a flowmeter 33 so as to adjust and control the circulation flow rate of the slurry. Here, the slurry temperature is not specifically limited and may be generally at 10° C. to 40° C. It is noted that the adjustment of the amount and the circulation flow rate of the slurry is described hereinafter.

Figure 2:
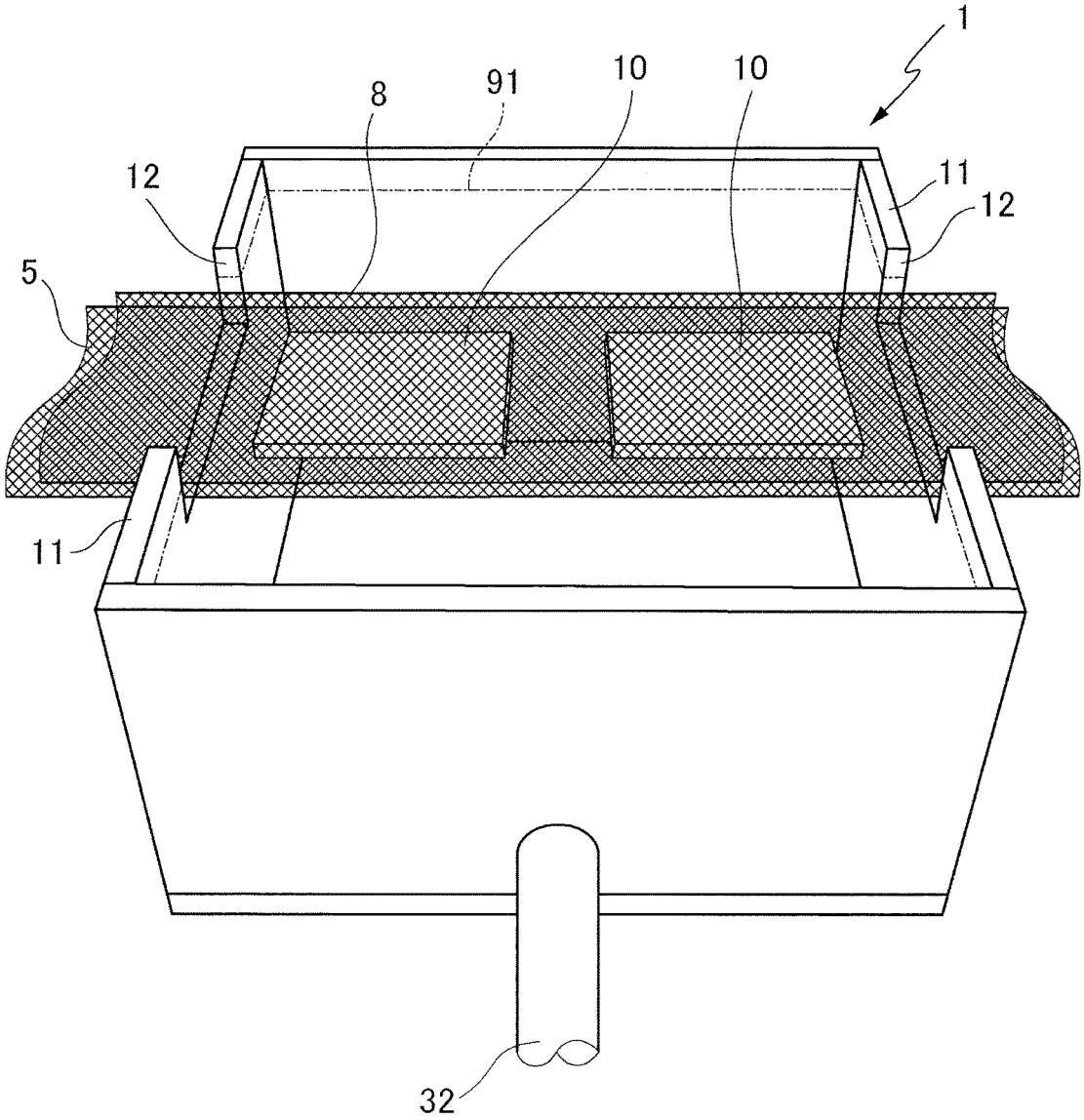
FIG. 2 is a perspective view depicting an inner tank (coating tank) of the application device.

As depicted in FIG. 2, the inner tank (coating tank) 1 is a box-shaped container which is open at the upper end face and has mutually facing side walls 11 that are cut out rectangularly at the central upper end portion to form net belt passage openings 12 individually. The pipe arrangement 32 of the slurry return means 3 is provided at the bottom of the inner tank 1, and the slurry 9 is continuously fed to the bottom of the inner tank (coating tank) 1 from the pipe arrangement 32 of the slurry return means 3 so that the slurry is overflowed from the upper end portion of the inner tank (coating tank) 1 including the net belt passage openings 12. On this occasion, when the feed amount (circulation flow rate) of the slurry is appropriately controlled, the slurry level in the inner tank 1 can be held at a position corresponding to an intermediate portion to an upper portion along the height of the net belt passage openings 12 as is particularly depicted by a dot-and-dash line 91 in FIG. 2. It is noted that the net belt passage opening 12 may be provided as a through-hole opening and may be formed at an arbitrary position corresponding to from an intermediate portion to an upper end portion along the height of the side walls 11. It will also be noted that in FIGS. 1 and 2, the inner tank 1 and the outer tank 2 have been illustrated each as a rectangular form for the convenience' sake, but no limitation should be placed on the shapes of these inner and outer tanks. Moreover, the net belt passage opening 12 provided in the inner tank 1 should not be limited to a rectangular one as depicted in FIG. 2, but may be in any form ensuring good passage of the net belt conveyor described hereinafter.

In FIG. 1, indicated by 5 is a circulation net belt conveyor driven by a motor 51, and a horizontal movement region at the upper side thereof is passed through the outer tank 2 and the inner tank 1. Indicated by 8 in the figure is a circulation pressing net belt driven by a motor 81, and its lower side horizontal movement region covers over the net belt of the net belt conveyor 5 and moves in synchronism with the net belt conveyor 5, and is passed through the outer tank 2 and the inner tank 1 along with the net belt conveyor 5. As depicted in FIG. 2, sintered magnet bodies 10 are held between the net belt conveyor 5 and the pressing net belt 8 and conveyed horizontally.

It is to be noted that the pressing net belt 8 is able to stop the movement of the sintered magnet bodies 10 under its own weight, so that when the sintered magnet bodies 10 are immersed in the slurry 9 or in some cases where drippings are removed or drying is performed as will be described hereinafter, there can be prevented mutual contact of the magnet bodies on the net belt conveyor 5 due to the movement, caused by the flow of the slurry and the injected air, of the sintered magnet bodies 10 mounted on the net belt conveyor 5. Thus, where the sintered magnet bodies 10 are heavy sufficiently not to cause the sintered magnet bodies 10 to be moved by the action of the slurry flow or the injected air, the pressing net belt 8 can be omitted.

As depicted in FIG. 2, the net belt conveyor 5 and the pressing net belt 8 are both immersed in the slurry accommodated in the inner tank 1 through the one net belt passage opening 12 of the inner tank (coating tank) 1 while holding the sintered magnet bodies 10, and are discharged from the inner tank 1 through the other net belt passage opening 12.

The circulation flow rate of the slurry 9 is adjusted in such a way that depending on the capacity of the inner tank 1 and the opening area of the net belt passage opening 12, the slurry level 91 (see FIG. 2) in the inner tank 1 is made higher than the sintered magnet bodies 10 held between the net belt conveyor 5 and the pressing net belt 8. In this case, when using a magnet pump or a slurry pump coping with a high specific gravity of up to 2.0, the circulation flow rate can be adjusted within a range of 15 to 500 liters/minute. For instance, it is preferred that if the capacity of the inner tank 1 is approximately at 0.5 to 20 liters, the circulation flow rate is adjusted within a range of 30 to 200 liters/minute so as to control the slurry level 91 in the inner tank 1 as mentioned above. In this case, if the flow rate is less than 30 liters/minute, difficulty is involved in keeping the slurry level 91 higher than the sintered magnet bodies 10 being conveyed, or the powder of a rare-earth compound in the circulation system is apt to be fixedly attached or coagulated with the likelihood of the rare-earth compound being settled in the system. On the other hand, when the slurry is circulated at a flow rate exceeding 200 liters/minute, there is no further merit, but the slurry is rather likely to be spread therearound and the wastage of electric consumption results more than anything else. The total amount of the slurry 9 may be one sufficient to reliably keep such a circulation flow rate as set out above.

The net belt of the net belt conveyor 5 and the pressing net belt 8 may be any net-shaped belts so far as they are able to stably hold and horizontally convey the sintered magnet bodies. In general, those net-like weaves of a metal wire are preferably used. In this case, although no specific limitation is placed, a chain-attached net belt is preferably used because stable running can be achieved using a sprocket drive.

Such a net belt is preferably such that the net is constituted of a rod (force bone) and a spiral (spiral), both made of a stainless steel wire, and a chain is attached to the net using bar pins or the like.

Since the net belt of the net belt conveyor 5 and the pressing net belt 8 are immersed in and applied with the slurry along with the sintered net bodies, the powder of a rare-earth compound deposits to make the wire thick unless the stainless steel wire used has not been subjected to surface treatment, then with concern that the meshwork of the net is clogged thereby causing a disadvantage in slurry application onto the sintered magnet bodies 10. Accordingly, although no limitation is placed, it is preferred to subject the net belts to coating so that the slurry is less likely to be attached thereto. Although the type of coating is not specifically limited, a fluorine resin coating such as polytetrafluoroethylene (Teflon (registered trademark)) is preferred in view of its excellent abrasion resistance and water repellency. Further, although not depicted, an ultrasonic cleaning tank may be provided so as to pass for cleaning the net belt conveyor 5 and the pressing net belt 8 therethrough, by which the net belt is invariably cleaned to prevent the deposition of the powder of a rare-earth compound. In this case, water or an organic solvent is used as a cleaning liquid, and ultrasonic cleaning is carried out at a frequency of approximately 26 to 100 kHz.

Further, although not specifically limited, it is preferred that a multitude of protrusions are provided at the upper surface of the net belt of the net belt conveyor 5 and the lower surface of the pressing net belt 8 so as to hold the individual sintered magnet bodies 10 on the protrusions, so that the contact area between the net belt and the surface of the sintered magnet body is made as small as possible thereby permitting the entire surface of the sintered magnet body 10 to be well contacted with the slurry. In this case, the protrusion can be formed by triangularly folding and upwardly projecting the spiral portion of the net belt. It is preferred to arrange such that a multitude of protrusions are formed and at least two portions of the sintered magnet body 10 are arranged in contact with the apexes of the protrusion.

If the wire diameter of the stainless steel wire forming these net belts is less than 1 mm for both a rod diameter and a spiral diameter, the stainless steel wire does not withstand long-term use and is apt to be deformed, so that the diameter of at least 1 mm is preferred although not specifically limited thereto. The net pitches including a spiral pitch and a rod pitch is preferably at least 3 mm. When the wire diameter and the pitch of the net belt conveyor 5 and the pressing net belt 8 are adjusted in this way, there can be obtained good durability of the net belts and a good powder coating amount. That is, because the sintered magnet bodies 10 placed on the net belt conveyor 5 is in contact with the steel wire of the net belt, the wire diameter and the pitch give not a little influence on the uniformity of the coating amount. Moreover, where the pressing net belt 8 is omitted, a difference in the coating amount from the upper side surface free of contact with the net is likely to be great. The adjustments of the wire diameter and the pitch lead to the improvement in uniformity of the coating amount due to the formation of an appropriate space enabling the smooth passage of the slurry onto the surface of the sintered magnet bodies along with improvements in strength and durability.

It is noted that the widths and the conveying speed (circulation speed) of the net belt conveyor 5 and the pressing net belt 8 are appropriately set depending on the morphology (size and shape) of the sintered magnet bodies 10 to be treated and the treating capacity required for the device and, although not specifically limited, the conveying speed is preferably 200 to 2,000 mm/minute and more preferably 400 to 1,200 mm/minute. If the conveying speed is less than 200 mm/minute, difficulty is involved in achieving an industrial satisfactory treating capacity. On the other hand, if over 2,000 mm/minute, drying failure is apt to occur, for example, in a dripping removal zone and a drying zone described hereinafter, and a blower for reliable drying has to be made larger in size or be increased in number, with some possibility that the dripping removal zone or the drying zone becomes large in scale.

Although no particularly depicted in FIG. 1, the application device is provided with a dripping removal zone in which the drippings of the slurry 9 are removed from the surface of the sintered magnet bodies 10 applied with the slurry 9 and discharged from the outer tank 2, and a dying zone in which the sintered magnet bodies 10 having been subjected to the dripping removal are dried to remove the solvent of the slurry 9 to form the film of the powder of the rare-earth compound. In this case, the sintered magnet bodies 10 applied with the slurry may be transferred to a separately provided conveying mechanism for passing through the dripping removal zone and the drying zone in which the dripping removal treatment and the drying treatment can be performed, or the sintered magnet bodies 10, which are discharged from the inner tank 1 and the outer tank 2 and horizontally conveyed while being held between the net belt conveyor 5 and the pressing net belt 8, may be conveyed, as they are, by means of the net belt conveyor 5 and the pressing net belt 8 and successively passed through the dripping removal zone and the drying zone to perform the dripping removal and the drying treatment. Unless otherwise illustrated, there is hereinafter described the case that the sintered magnet bodies 10 discharged from the outer tank 2 are conveyed, as they are, by means of the net belt conveyor 5 and the pressing net belt 8 and are successively passed through the dripping removal zone and the drying zone.

The configurations of the dripping removal zone and the drying zone are not specifically limited. For example, there are provided dripping removal means and drying means each made up of air injection nozzles arranged at upper and lower sides of the net belt conveyors 5 overlaid with the pressing net belts 8 individually. Air is injected against the horizontally conveyed sintered magnet bodies 10 from the nozzles of the dripping removal means to remove drippings, after which hot air is injected from the nozzles of the drying means to dry the sintered magnet bodies 10. In this case, the nozzle configurations for the dripping removal means and the drying means are not specifically limited. Slit-type nozzles having a length corresponding to the width of the bet belt conveyor 5 are preferably used and are disposed at the upper and lower sides of the net belt conveyor 5, and may be appropriately arranged so that the upper and lower nozzles are either in a facing state or in a zigzag state.

Although the temperature of the hot air of the drying means is not specifically limited, it may be appropriately adjusted within a range of the boiling point ($T_B$) of a solvent for the slurry 9±50° C. although depending on the drying time (a conveying speed and a drying zone length), the size and shape of the sintered magnet body, and the concentration of the slurry and coating amount. For instance, where water is used as a solvent for the slurry, the hot air temperature may be adjusted within a range of 40° C. to 150° C., preferably 60° C. to 100° C. It is noted that in order to facilitate the drying in some cases, the air injected from the dripping removal means may be the same as hot air.

The air or hot air flow injected from the nozzles of the dripping removal means or the drying means is appropriately adjusted depending on the conveying speed of the sintered magnet bodies 10, the length of the dripping removal zone 6 or the drying zone 7, the size and shape of the sintered magnet bodies 10, and the concentration of the slurry and the coating amount. Although not specifically limited, in general, the air flow is adjusted within a range of 300 to 2,500 liters/minute, preferably within a range of 500 to 1,800 liters/minute.

It is noted that the dripping removal zone (with dripping removal means) is not always an essential configuration, but may be omitted in some cases. Although the dripping removal can be performed simultaneously with the drying in the drying zone (with drying means), drying in the presence of drippings on the surface of the sintered magnet bodies 10 is apt to cause the coating irregularities of the powder, so that it is preferred to carry out the drying after reliable removal of the drippings in the dripping removal zone (with dripping removal means).

Although not specifically limited, a chamber covering the dripping removal zone and the drying zone may be provided. Preferably, the dripping removal zone and the drying zone are covered with the chamber in this way and dust is collected by suction in the chamber with a dust collector, for which it is preferred to provide dust collection means for collecting the powder of a rare-earth compound removed from the surface of the sintered magnet bodies 10 during the dripping removal and the drying. This enables the coating of a powder of a rare-earth compound without waste of the rare-earth compound containing a valuable rare-earth element. The provision of such dust collecting means enables the drying time to be quickened, and the hot air is prevented as far as possible from coming around to the slurry application unit made of the inner tank 1, the outer tank 2, the slurry return means 3 and the like, so that the slurry solvent can be effectively prevented from being evaporated with the hot air. It is noted that the dust collector may be either of a wet type or of a dry type. In order to reliably achieve the above effect, it is preferred to choose a dust collector whose suction capability is greater than a blown air flow from the nozzles of the dripping removal means and the drying means.

When a powder (a powder of a rare-earth compound) containing one or at least two selected from an oxide, a fluoride, an oxyfluoride, a hydroxide, or a hydride of $R^2$ (wherein $R^2$ is one or at least two selected from rare-earth elements including Y and Sc) is applied onto the surface of the sintered magnet bodies 10 by use of the application device, the slurry 9 dispersing the powder in a solvent is circulated by being initially accommodated in the inner tank 1 and the liquid storage tank 4, being continuously supplied to the inner tank 1 by means of the pump 31 of the slurry return means 3, being overflowed from the upper portions of the inner tank 1 including the net belt passage openings 12, being received with the outer tank 2, being returned to the liquid storage tank 4, and being again returned to the inner tank 1 by the slurry return means 3. This enables the slurry 9 to become accommodated in the inner tank 1 invariably at a given amount while being well agitated, and the slurry level 91 in the inner tank 1 is held at a position higher than the net belt conveyor 5 and the pressing net belt 8 as depicted in FIG. 2.

In this state, the sintered magnet bodies 10 are placed side-by-side at the upstream side of the horizontal conveying portion of the net belt conveyor 5 and are horizontally conveyed at a given speed in a state held between the net belt conveyor 5 and the pressing net belt 8.

In the state held between the net belt conveyor 5 and the pressing net belt 8 as depicted in FIG. 2, the sintered magnet bodies 10 are entered from one net belt passage opening 12 into the inner tank 1, passed through the slurry 9 in the state of immersion in the slurry 9 and discharged from the other net belt passage opening 12 to the outside of the inner tank 1. In this way, the slurry 9 is continuously applied onto a plurality of sintered magnet bodies 10.

The sintered magnet bodies 10 applied with the slurry 9 are further horizontally conveyed in the state held between the net belt conveyor 5 and the pressing net belt 8, passed through the dripping removal zone to remove the drippings as stated before, and moved into the drying zone and subjected to such drying operations as set out before to remove the solvent of the slurry 9. Eventually, the powder of a rare-earth compound is fixedly deposited on the surface of the sintered magnet bodies 10 to form a coating film made of the powder of a rare-earth compound on the surface of the sintered magnet bodies 10.

In this manner, the sintered magnet bodies 10 applied with the powder of a rare-earth compound and discharged from the drying zone are collected from the net belt conveyor 5, followed by heat treatment to permit the $R^2$ of the rare-earth compound to be absorbed and diffused thereby obtaining rare-earth permanent magnets.

Here, the application operations of the rare-earth compound are repeated plural times using the application device to recoat the powder of a rare-earth compound, so that not only a thicker coating film can be obtained, but also the uniformity of the coating film can be more improved. Although the application operations may be repeated by passing through one device plural times, it may be possible to take the application device as one module and arrange, for example, 2 to 10 modules in series depending on the desired coating film thickness, followed by repeating a powder application process including from the application of the slurry to the drying the number of times corresponding to the number of the modules. In this case, the modules may be connected in such a way that using a robotic system or an intermediate conveyor belt, the sintered magnet bodies 10 are transferred to the net belt conveyor 5 of a next module. Alternatively, the net belt conveyor 5 and the pressing net belt 8 may be provided as a common facility for passage through the respective modules, under which when the sintered magnet bodies are passed through a plurality modules by means of the net belt conveyor 5 and the pressing net belt 8, the powder application process can be repeated plural times.

When the powder application process including from the slurry application to the drying is repeated plural times to carry out thin film recoating, a coating film having a desired thickness can be provided, and the drying time can be shortened by the thin film recoating, thereby enabling a time efficiency to be improved. Also, when the application operations are repeated using one device or the sintered magnet bodies are delivered to between the net belt conveyors 5 of the respective modules, such effects are obtained that the positions of the contact points with the net belt conveyor 5 and the pressing net belt 8 are deviated from one another during the delivering motion and thin multilayer coating is carried out, thereby leading to a further improvement in the uniformity of the resulting film.

In this way, according to the production method of the present invention in which the application of the powder of a rare-earth compound is carried out using the application device, the sintered magnet bodies 10 are immersed in and applied with the slurry 9 in the state that the slurry 9 is overflowed from the upper portion of the coating tank (inner tank) 1, so that the application by immersion can be performed while invariably keeping the slurry 9 in a given state. Moreover, since the slurry 9 is applied/dried while conveying with the net belt conveyor 5, the application treatment of the powder of a rare-earth compound against a plurality of sintered magnet bodies 10 can be continuously performed. Further, since the application and the drying are carried out while horizontally conveying with the net belt conveyor 5, a multitude of sintered magnet bodies 10, which are arranged at small intervals and conveyed, can be continuously treated in an extremely efficient manner without mutual contact of adjacent sintered magnet bodies, thus easily enabling automatization. Accordingly, the powder of a rare-earth compound can result in a uniform amount of coating and the coating amount can be controlled more accurately, thereby enabling an even, uniform coating film of the powder of a rare-earth compound to be efficiently formed. When the sintered magnet bodies uniformly applied with the powder are heat treated to permit the rare-earth element indicated by $R^2$ to be absorbed and diffused, there can be efficiently produced rare-earth magnets having excellent magnetic properties including well increased coercivity.

It is noted that the heat treatment permitting the rare-earth element indicated by $R^2$ to be absorbed and diffused may be carried out according to any known methods. Moreover, after the heat treatment, known post-treatments including aging treatment under appropriate conditions and grinding into a practical shape may be performed, if necessary.

EXAMPLES

The more specific modes of the present invention are described in detail by way of Examples, which should not be construed as limiting the present invention thereto.

Examples 1 to 3

An alloy in thin plate form was prepared by a strip casting technique, specifically by weighing Nd, Al, Fe and Cu metals having a purity of at least 99 wt %, Si having a purity of 99.99 wt %, and ferroboron, high-frequency heating in an argon atmosphere for melting, and casting the alloy melt on a copper single roll. The alloy consisted of 14.5 at % of Nd, 0.2 at % of Cu, 6.2 at % of B, 1.0 at % of Al, 1.0 at % of Si, and the balance of Fe. Hydrogen decrepitation was carried out by exposing the alloy to 0.11 MPa of hydrogen at room temperature to occlude hydrogen and then heating at 500° C. for partial dehydriding while evacuating to vacuum. The decrepitated alloy was cooled and sieved, yielding a coarse powder under 50 mesh.

The coarse powder was finely pulverized by a jet mill using a high pressure nitrogen gas in such a way that the powder had a weight intermediate particle size of 5 μm. The mixed fine powder obtained in this way was formed into a block at a compression pressure of approximately 1 ton/cm$^2$ while being oriented in a magnetic field of 15 kOe in an atmosphere of nitrogen. This formed body was charged into a sintering furnace in an atmosphere of Ar and sintered at 1,060° C. for two hours to obtain a magnet block. This magnet block was ground with a diamond cutter on the entire surface thereof, followed by rinsing with an alkaline solution, pure water, nitric acid, and pure water in this order and drying to obtain a block-shaped magnet body having a size of 17 mm×17 mm×2 mm (magnetically anisotropic direction).

Next, a dysprosium fluoride powder was mixed with water at a mass fraction of 40% and well dispersed to prepare a slurry. Using the application device depicted in FIGS. 1 and 2 (including such a dripping removal zone and a drying zone as stated before), the slurry was applied onto the magnet body and dried to form a coating film made of the dysprosium fluoride powder. On this occasion, the application, dripping removal, and drying were repeated to a coating amount ensuring that the effect of increasing coercivity reached a peak. Also, the three types of stainless steel net belts indicted in the following Table 1 were provided as the net belt conveyor 5 and the pressing net belt 8 of the application device, and different net belts were individually used in Examples 1 to 3, as is particularly depicted in Table 2. It is noted that the application conditions were as follows.

Application Conditions
Capacity of inner tank: 1 liter
Circulation flow rate of slurry: 90 liters/minute
Conveying speed: 700 mm/minute
Air flow during dripping removal and drying: 1,000 liters/minute
Hot air temperature on drying: 80° C.

Figure 3:
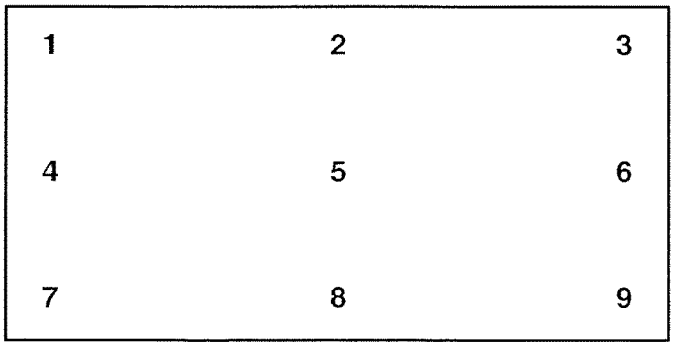
FIG. 3 is an illustrative view depicting positions at which a sample for measurement is cut out from the resultant rare-earth magnet in examples.

The magnet body, on which the thin film of the dysprosium fluoride powder had been formed on a surface thereof, was subjected to heat treatment in an atmosphere of Ar at 900° C. for five hours to perform absorption treatment and further aged at 500° C. for one hour and quenched to obtain a rare-earth magnet. The magnet body was cut away at nine points of the central and end portions of the magnet depicted in FIG. 3 into 2 mm×2 mm×2 mm pieces and their coercivities were measured. The results are depicted in Table 2.

TABLE 1

| | Kind | Form | Minimum spacing or spiral pitch (mm) | Rod pitch (mm) | Wire rod diameter (mm) | Spiral wire diameter (mm) |
|---|---|---|---|---|---|---|
| Net belt 1 | Wire conveyor belt | Flat type | Minimum spacing 30 | 5.0 | 1.2 | 0.9 |
| Net belt 2 | Chain attached conveyor belt | Constant thickness type | Spiral pitch 8.0 | 10.2 | 1.5 | 1.2 |
| Net belt 3 | | Triangle spiral type | Spiral pitch 8.0 | 10.2 | 1.5 | 1.2 |

TABLE 2

| | | Increased amount of coercivity at respective measured points (kA/m) | | | | | | | | |
|---|---|---|---|---|---|---|---|---|---|---|
| | Net belt | 1 | 2 | 3 | 4 | 5 | 6 | 7 | 8 | 9 |
| Example 1 | Net belt 1 | 480 | 440 | 470 | 450 | 445 | 460 | 485 | 420 | 460 |
| Example 2 | Net belt 2 | 475 | 460 | 450 | 470 | 440 | 470 | 450 | 470 | 450 |
| Example 3 | Net belt 3 | 470 | 480 | 480 | 480 | 480 | 480 | 475 | 460 | 480 |

As depicted in Table 2, good increased amount of coercivity effects are obtained for all the rare-earth magnets by the grain boundary diffusion treatment. With the flat conveyor (Example 1) and the constant thickness type conveyor (Example 2), the contact area between the stainless steel wire and the magnet is great, so that the powder of a rare-earth compound is less likely to be applied onto the magnet at the contact portions and is in a thin state. In contrast, there is a tendency that the vicinities of the portions are coated thickly, and slight variations appear for the coating amount and the increased amount of coercivity. While on the other hand, with the triangle spiral type net belts (Example 3), the powder of a rare-earth compound goes around through the in-plane area of the magnet, so that a variation-reduced, more stable increment of coercivity is obtained.

Examples 4 to 6 and Comparative Example 1

Using an application device of similar type in Example 3, a sintered magnet body made in similar way and a similar slurry was applied and dried under similar conditions to form a coating film made of a dysprosium fluoride powder on the magnet body. On this occasion, when slurry application→dripping removal→drying using the application device of FIG. 1 (including the dripping removal zone and the drying zone as set out before) is taken as one application cycle, the cycle was repeated twice (Comparative Example 1 and Example 4), thrice (Example 5), and six times (Example 6) thereby conducing multilayer coating. In this case, in Comparative Example 1, although the application was carried out twice, drying after the first application was skipped. There was measured a ratio of the coating amount of the dysprosium fluoride powder applied onto the surface of the respective rare-earth magnets (i.e. a ratio in the case where a coating amount, at which the coercivity increasing effect reaches equilibrium, is taken as 1.00). The results are depicted in Table 3.

The respective sintered magnet bodies obtained in this way were heat treated in similar manner in Example 3 to obtain rare-earth magnets. The respective rare-earth magnets were evaluated according to the following method with respect to an increased amount of coercivity. The results are depicted in Table 3. It is noted that a magnet, which was subjected to one module of the application treated without repeating the application and heat treated, was provided as a control and subjected to measurement of the coating amount ratio and the increased amount of coercivity.

[Measurement of Increased Amount of Coercivity]

The respective rare-earth magnets obtained in this way were individually cut away into 2 mm×2 mm×2 mm magnet bodies at nine points of the central and end portions thereof and their coercivity was measured and an increased amount of coercivity was calculated. The increased amount of coercivity was indicated by an average value of nine magnetic pieces.

TABLE 3

| | Number of recoatings | Process | Coating amount ratio | Increased amount of coercivity (kA · m) |
|---|---|---|---|---|
| Comparative Example 1 | 2 modules (no drying in the first module) | Application → Dripping removal → Application → Dripping removal → Drying | 0.48 | 108 |
| Example 4 | 2 recoating modules | (Application → Dripping removal → Drying) × 2 | 0.73 | 290 |
| Example 5 | 3 recoating modules | (Application → Dripping removal → Drying) × 3 | 0.86 | 384 |
| Example 6 | 5 recoating modules | (Application → Dripping removal → Drying) × 5 | 1.00 | 485 |
| Control | 1 module (no recoating) | Application → Dripping removal → Drying | 0.27 | 65 |

As depicted in Table 3, when slurry application→dripping removal→drying is taken as one application cycle and this cycle is repeated plural times, the coating amount can be adjusted. Moreover, the net contact spots are moved thereby improving the uniformity of the coating amount. Eventually, an increasing variation of coercive force can be reduced.

It is noted that when the second application cycle is carried out without drying as in Comparative Example 1, the rare-earth compound coated in the first cycle is merely washed away with the solvent in the second application tank, so that a satisfactory recoating effect cannot be obtained.

REFERENCE SIGNS LIST

1 inner tank (coating tank)
11 two mutually facing side walls
12 net belt passage openings
2 outer tank
3 slurry return means
31 pump
32 pipe arrangement
33 flowmeter
4 liquid storage tank
5 net belt conveyor
51 motor
8 pressing net belt
81 motor
9 slurry
91 slurry level
10 sintered magnet bodies

The invention claimed is:

1. A method for producing rare-earth magnets by applying a powder containing one or at least two selected from an oxide, a fluoride, an oxyfluoride, a hydroxide, or a hydride of $R^2$ (wherein $R^2$ represents one or at least two selected from rare-earth elements including Y and Sc) onto sintered magnet bodies made of an $R^1$—Fe—B-based composition (wherein $R^1$ is one or at least two selected from rare-earth elements including Y and Sc) and heat treated to permit $R^2$ to be absorbed in the sintered magnet bodies, the method comprising:

providing a coating tank having net belt passage openings at two mutually facing side walls individually and a net belt conveyor for conveying the sintered magnet bodies, the net belt conveyor arranged to pass through the net belt passage openings, so that a plurality of the sintered magnet bodies on the net belt conveyor can be continuously conveyed horizontally through the net belt passage openings;

continuously feeding to the coating tank a slurry dispersing the powder in a solvent, so that i) a level of the slurry in the coating tank is held at a position higher than an upper surface of the sintered magnet bodies on the net belt conveyor to immerse the sintered magnet into the slurry, and ii) the slurry continuously overflows from an upper end portion of the coating tank including the net belt passage openings and the level of slurry is continuously maintained to be at a level above a lower part of the net belt passage openings;

placing the plurality of the sintered magnet bodies on the net belt conveyor and continuously conveying the sintered magnet bodies on the net belt conveyor horizontally through the net belt passage openings so that the sintered magnet bodies are immersed into the slurry in the coating tank to apply the slurry to the sintered magnet bodies; and drying the sintered magnet bodies to remove the solvent of the slurry thereby continuously applying the powder onto the plurality of sintered magnet bodies.

2. The method for producing rare-earth magnets of claim 1, wherein the sintered magnet bodies are subjected to plural times of an application process in which the sintered magnet bodies are passed into the slurry in the coating tank and dried.

3. The method for producing rare-earth magnets of claim 1, wherein the sintered magnet bodies are discharged from the coating tank and air is injected against the conveyed sintered magnet bodies to remove drippings therefrom, followed by drying treatment.

4. The method for producing rare-earth magnets of claim 1, wherein the drying treatment is carried out by injecting air at a temperature within ±50° C. of a boiling point ($T_B$) of the solvent for the slurry against the rare-earth magnets.

5. The method for producing rare-earth magnets of claim 1, wherein a net belt of the net belt conveyor is covered with a pressing net belt and the sintered magnet bodies are conveyed while being held between these net belts.

6. The method for producing rare-earth magnets of claim 1, wherein the slurry is fed to a bottom of the coating tank so that i) the level of the slurry in the coating tank is held at the position higher than the upper surface of the sintered magnet bodies on the net belt conveyor to immerse the sintered magnet into the slurry, and ii) the slurry continuously overflows from the upper end portion of the coating tank including the net belt passage openings and the level of slurry is continuously maintained to be at the level above the lower part of the net belt passage openings.

7. The method for producing rare-earth magnets of claim 1, wherein the slurry, which is overflowed from the coating tank, is returned to the coating tank.

8. The method for producing rare-earth magnets of claim 1, wherein the slurry is overflowed from the coating tank to an outer tank, and the slurry, which is overflowed from the coating tank, is returned from the outer tank to the coating tank.

9. The method for producing rare-earth magnets of claim 1, wherein the slurry, which is overflowed from the coating tank, is returned to the coating tank by a pump.

10. The method for producing rare-earth magnets of claim 1, wherein the slurry is overflowed from the coating tank to an outer tank, and the slurry, which is overflowed from the coating tank, is returned from the outer tank to the coating tank by a pump.

* * * * *